US005809668A

United States Patent [19]

Kiniry et al.

[11] Patent Number: 5,809,668

[45] Date of Patent: Sep. 22, 1998

[54] COMPOSITE SNOWSHOE

[75] Inventors: Daniel P. Kiniry, Shelburne, Vt.; Francis E. Mahoney, Goffstown, N.H.

[73] Assignee: Tubbs Snowshoe Company, Stowe, Vt.

[21] Appl. No.: 961,003

[22] Filed: Oct. 30, 1997

[51] Int. Cl.[6] ..... A63C 13/00; A43B 5/04

[52] U.S. Cl. ..... 36/122; 36/124; 36/125

[58] Field of Search ..... 36/122, 123, 124, 36/125

[56] References Cited

U.S. PATENT DOCUMENTS

| | | | |
|---|---|---|---|
| 4,045,889 | 9/1977 | Woolworth | 36/122 |
| 4,351,121 | 9/1982 | Wallace | 36/125 |
| 5,440,827 | 8/1995 | Klebahn et al. | 36/125 |
| 5,493,794 | 2/1996 | McKenzie et al. | 36/125 |
| 5,531,035 | 7/1996 | Forrest | 36/125 |
| 5,553,403 | 9/1996 | McManus | 36/122 |

*Primary Examiner*—M. D. Patterson
*Attorney, Agent, or Firm*—Ross, Ross & Flavin

[57] ABSTRACT

In a composite snowshoe, a thermosetting plastic deck or jacket wholly or partially encapsulates an aluminum tubing frame which includes an integral toe cord axle insert molded with the deck or jacket, with a boot binding system mechanically interlocked with the deck and frame which includes integral traction cleats, a crampon, longitudinal, serrated ribs on the underside of the deck to provide lateral stability when traversing a slope and improved traction when climbing an incline and diagonal ribs on the deck for strengthening the longitudinal ribs and adding traction in packed snow.

6 Claims, 6 Drawing Sheets

COMPOSITE SNOWSHOE

The invention relates to an improved snowshoe wherein the snowshoe body is comprised of a composite molding with inserted frame and axle.

High performance snowshoes are currently produced by mechanically attaching components to (a) a rigid frame, or (b) a plastic molded snowshoe body. The combination of rigid and flexible (plastic) materials is required to furnish structural integrity, flotation, traction, and a foot pivoting mechanism, at minimum weight.

A common design approach to the strength/weight challenge is the utilization of a rigid frame (usually wood, or aluminum tubing). The floatation means, either lacing material (leather or synthetic strips), or extruded plastic sheet, is attached to the frame. A foot pivoting means, (toe cord, or axle) is also attached to the rigid frame. This design approach requires a multitude of fastening components, and extensive assembly labor.

Another existing design approach, is the injection molded plastic snowshoe. Semi rigid plastic materials are used, which combine frame and floatatiqn characteristics. These snowshoes require attachment of axles, frame stiffeners, and traction components (cleats). Many of the designs have weight reduction features (cored sections) which have a tendency to pack in snow. One manufacturer attaches an "L" shaped metal extrusion to provide stiffness, traction and axle support. The shortcomings of this approach include the need for multiple parts (fasteners), and the plastic mass (weight) needed to achieve snowshoe stiffness. Aluminum framed snowshoes are known and are designed to support the foot pivot mechanism (axle, toe cord) by 1) penetrating the tubing frame or 2) by slinging the pivot between the frame sides. The shortcomings of each are: 1) the frame is weakened, a rod bearing is required, and unless properly sealed, the tubing may pick up water; and 2) a taut sling produces excessive collapsing forces in the frame. The toe cord must sag when under load, decreasing control, both axial and lateral.

The invention hereof comprises a snowshoe fabricated from a molded thermosetting plastic or polymer such as urethane with an encapsulated metallic frame. The encapsulation may be either total, or partial. In a preferred embodiment, a thermosetting plastic deck or jacket partially encapsulates an aluminum tubing frame, which offers maximum stiffness at minimum weight. Other benefits of the invention include: 1) elimination of parts and labor to assemble frame and deck, 2) the plastic deck or jacket around the frame not only strengthens the snowshoe, but also dampens vibration (sound), adds traction (both axial and lateral directions), and provides a buffer between hard surfaces (rocks) and the frame.

The molded snowshoe hereof includes an integral axle (toe cord). The axle is "insert molded" with the snowshoe body. The binding is designed to provide only a shear loading on the axle. There are no collapsing forces to interfere with user control.

The invention hereof provides a snowshoe/binding system which provides a mechanical interlock. A snowshoer traversing an incline, exerts a twisting force (couple) to the snowshoe binding. The twisting couple is most prevalent when the snowshoer's weight is on the heel. Herein, the problem is addressed by strengthening the pivot mechanism and extending the foot support to the heel area. This invention provides two methods of interlocking the binding with the snowshoe to eliminate the twisting force on the pivot mechanism. 1) The deck portion of the snowshoe has a molded aperture which mates with male ribs extending from the binding body. As the heel approaches contact with the snowshoe, the ribs self align with the aperture, and prevent lateral movement. 2) The top surface of the snowshoe deck has upstanding ribs which interlock with a Vee shape feature on the binding body. The two systems demonstrate two methods of achieving the alignment interlock. The interlocks, and a sturdy pivot mechanism provide a distinct improvement in lateral control.

The molded snowshoe hereof includes integral spikes or cleats. High performance snowshoes of the prior art normally have traction cleats attached to the binding, frame, or deck area. The cleats are attached with various types of hardware, adding weight and cost. The stainless steel spikes or cleats hereof are designed to be pressed into the molded deck, and offer the advantages of low weight and fewer parts.

In the composite snowshoe of the invention, longitudinal ribs have been added to the underside of the deck to provide lateral stability when traversing a slope. The ribs also have a serrated form which provides improved traction when climbing an incline.

Diagonal ribs have been added to the deck. These ribs strengthen the longitudinal ribs, and add traction, especially in packed snow.

The snowshoe hereof employs a unique binding design.

A relatively soft, high friction plastic material, sold under the trademark HYPOLON is used to achieve excellent "gripping" contact with a wide variety of boot sizes and shapes. HYPOLON, while being very flexible, has a tendency to lie in a "messy pile" when not in use. In addition to being unattractive, such as for sales display, it is difficult to mount on a boot.

The invention hereof adds a stiffer plastic material, sold under the trademark QUALEX to the outer surface of the HYPOLON components to offer some shape to the binding. The benefits include ease of mounting, appearance, and strength, especially in rivet areas.

Figure 1:
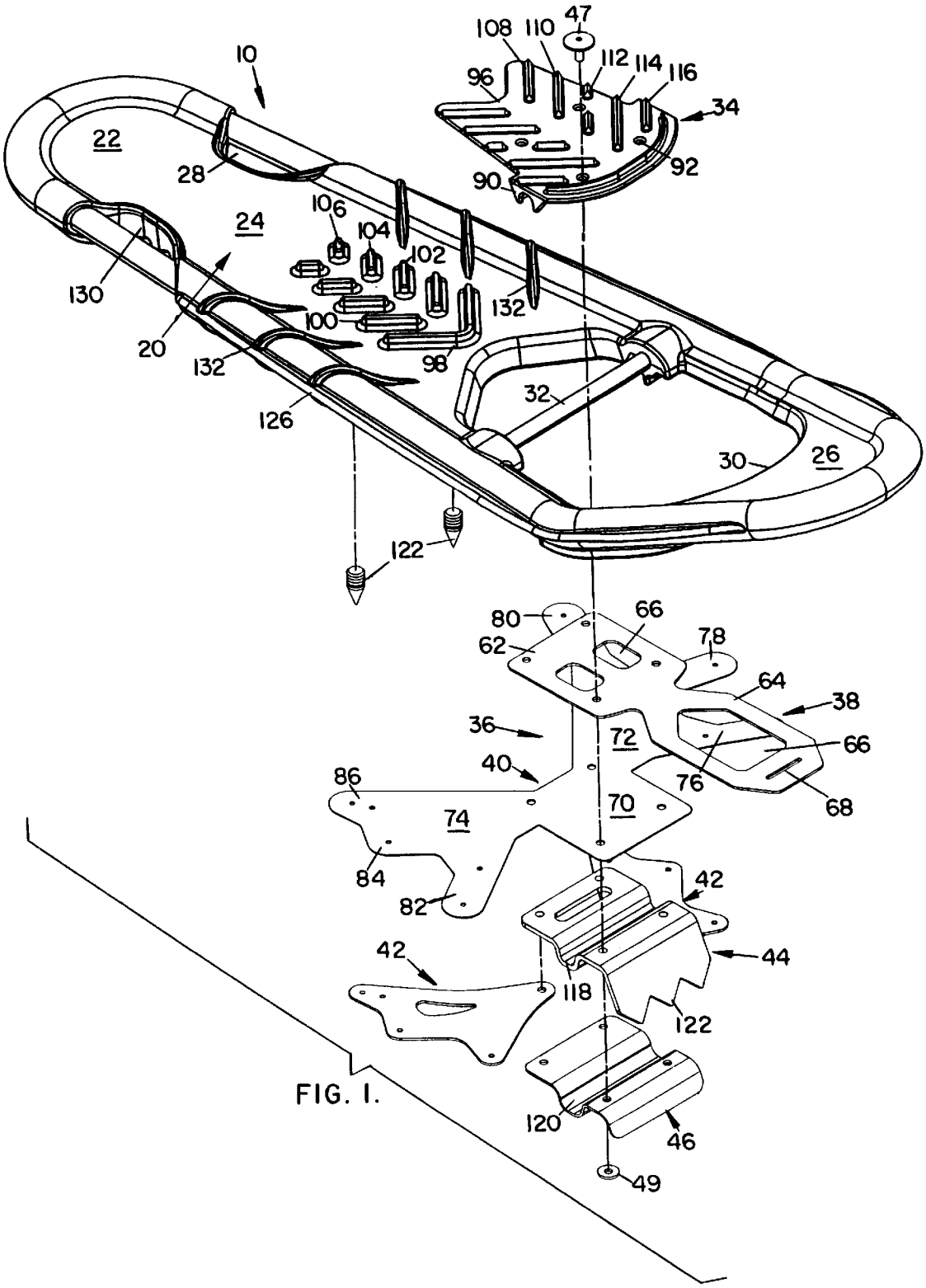
FIG. 1 is an exploded, perspective view of a composite snowshoe embodying a preferred form of the invention, with boot binding straps and attachment buckles omitted for clarity.

The composite snowshoe of the invention includes a tubular frame 10, of the usual oval or snowshoe shape preferably fabricated from a lightweight metal such as aluminum having substantially flat integral rear and main body portions 12 and 14 respectively, and an upwardly inclined forward end portion 14.

As best seen in FIGS. 14-17 frame 10 is formed from a single length of tubing bent into an oval or loop shape with one end being deformed or crimped as at 18 and inserted into the adjacent open end in the manner of a press fit so that the ends are tightly interengaged so as to be virtually inseparable.

Frame 10 is wholly or partially encapsulated by a lightweight, rigid thermosetting plastic polymer such as urethane or the like to form a rigid deck or jacket 20 having integral, substantially planar rear, main body and forward end portions 22, 24 and 26 respectively.

Figure 14:
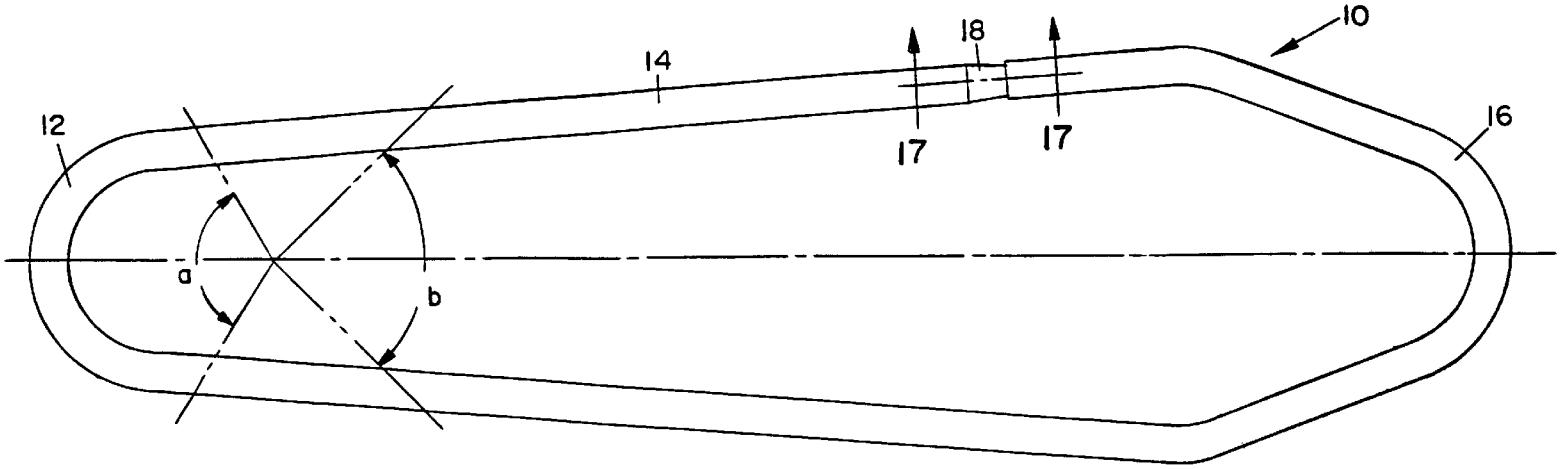
FIG. 14 is a top plan view of the tubular metal frame of the composite snowshoe of the invention.
Figure 15:
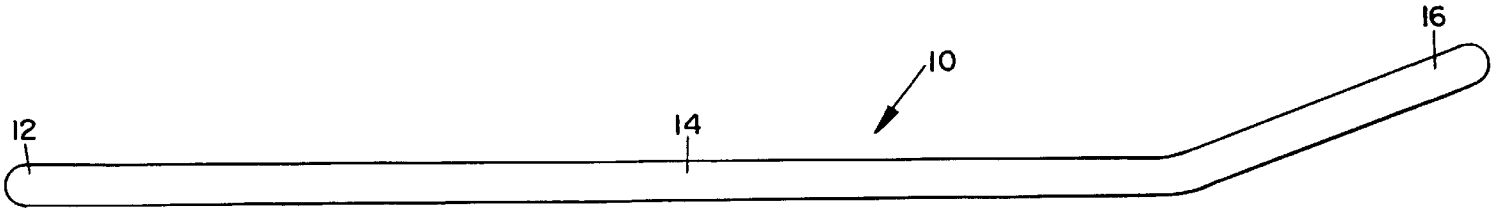
FIG. 15 is a front elevational view of the tubular metal frame of FIG. 14.
Figure 17:
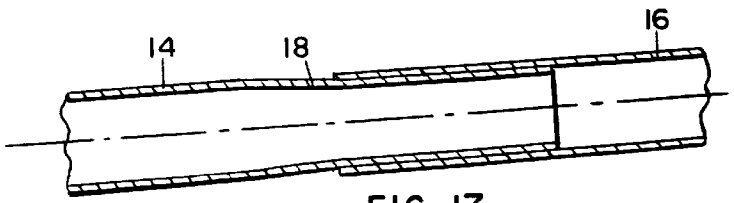
FIG. 17 is an enlarged, fragmentary cross sectional view taken on line 17—17 of FIG. 14.
Figure 16:
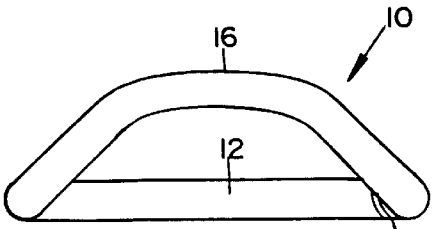
FIG. 16 is an end elevational view of the tubular metal frame of FIG. 14 as seen from the right.

In the preferred embodiment as shown, frame 10 is partially encapsulated so as not to be encapsulated in the areas indicated by the letters a and b in FIG. 14 adjacent its rear portion 12 to provide spaced apertures 28 in rear deck portion 22 disposed on opposite sides of the frame.

These unencapsulated areas reveal the presence of the frame to indicate snowshoe strength; help in weight reduction; and produce areas at the rear of the snowshoe disposed inwardly of the snowshoe sides for the provision of traction ribs on the lower surface of the deck, as will appear.

Deck 20 has a molded substantially oval longitudinally extending aperture 30 adjacent its forward end traversed by a tubular metal axle 32 wich is insert molded at its opposite ends into deck main body portion 24.

Pivoted to axle 32 so as to partially bridge aperture 30 is a substantially, planar, rectangular, plastic binding plate 34 fabricated from nylon or the like which provides, along with deck main body portion 24, a platform for the sole of the boot of a user, not shown.

Figure 2:
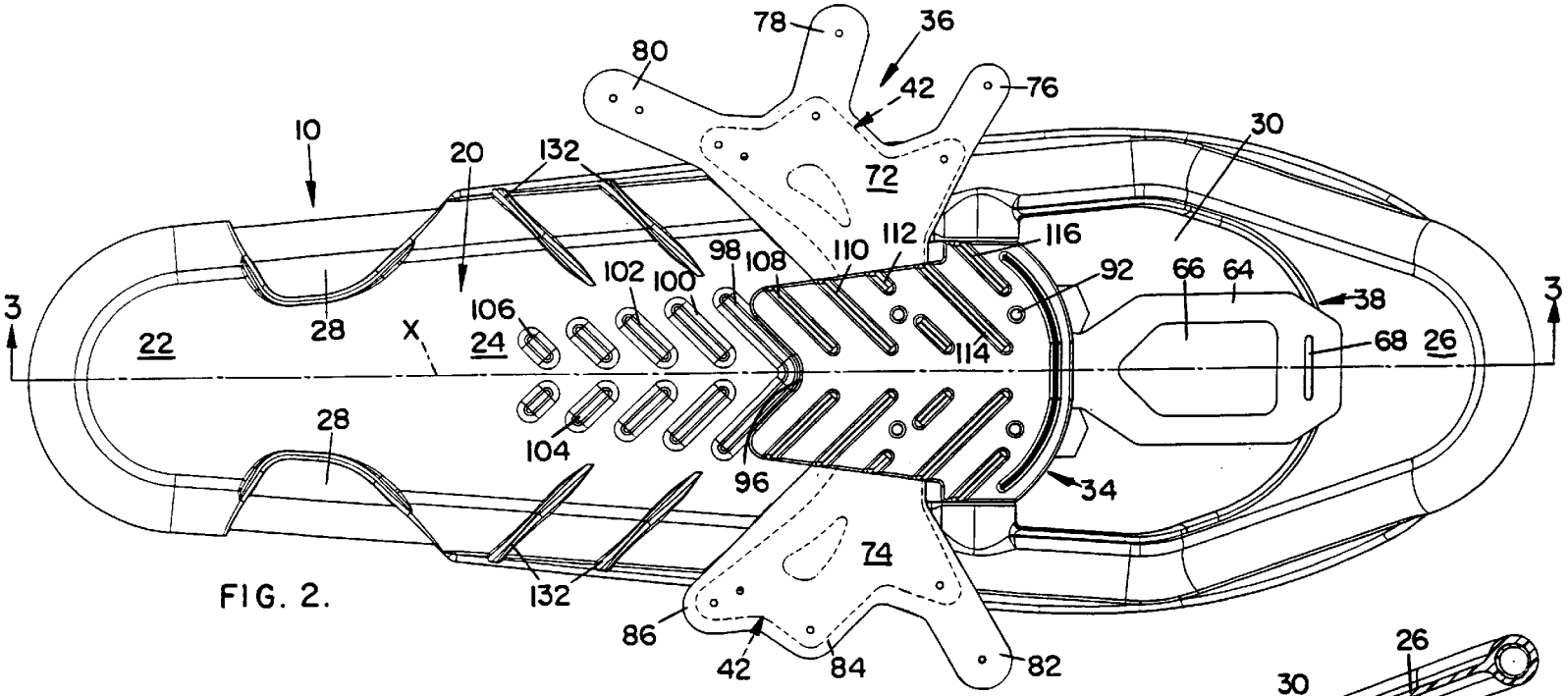
FIG. 2 is a top plan view of the composite snowshoe of FIG. 1.
Figure 3:
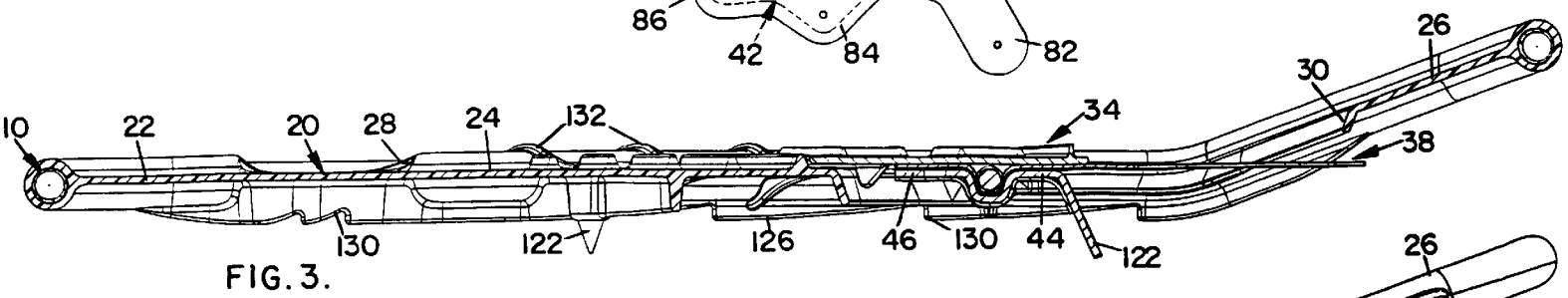
FIG. 3 is a cross sectional view taken on line 3—3 of FIG. 2.
Figure 4:
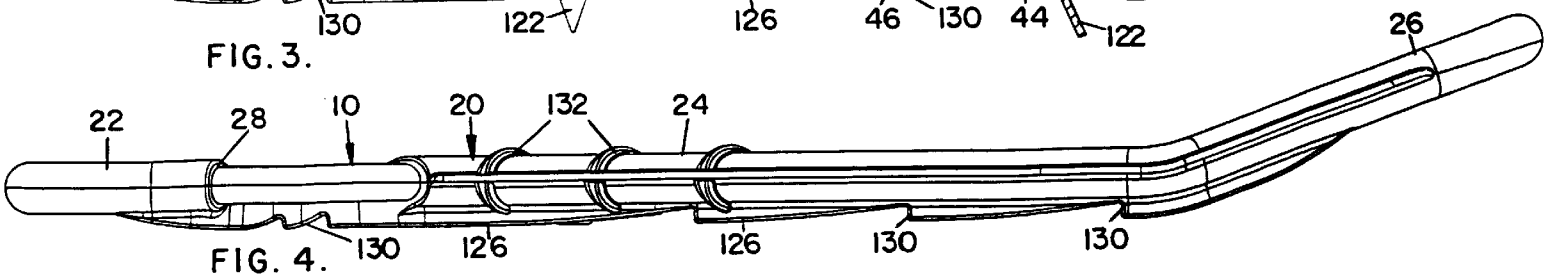
FIG. 4 is a front elevational view of the composite snowshoe of FIG. 2, with the binding plate, cleats and crampon omitted.
Figure 5:
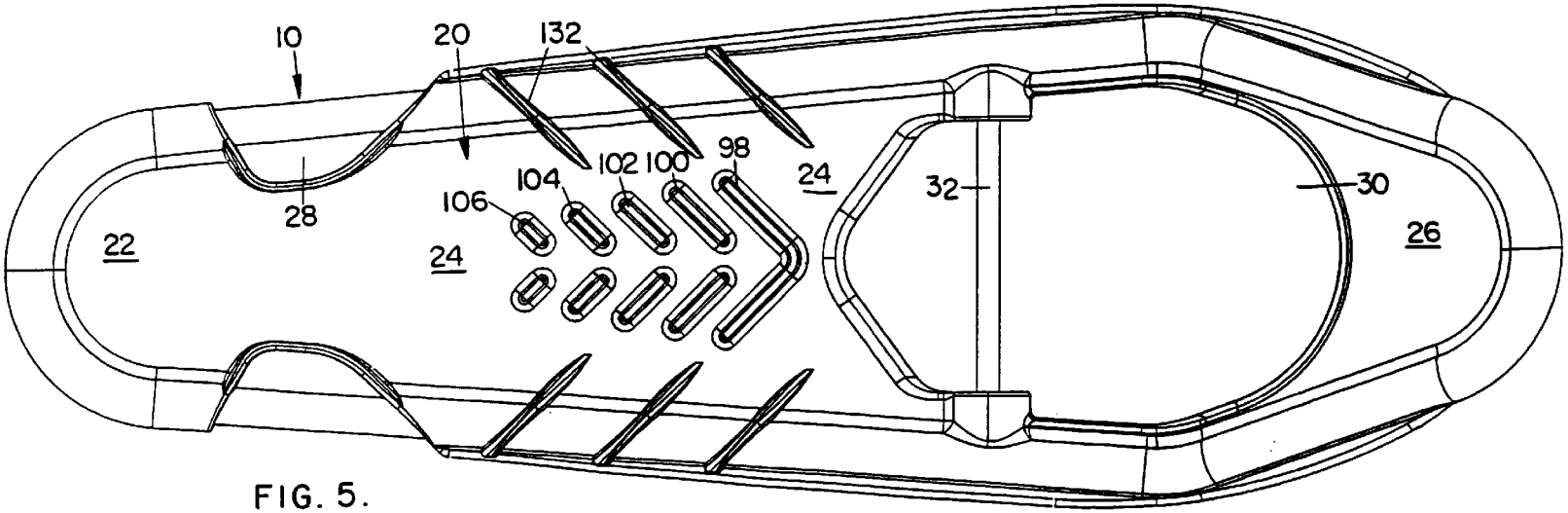
FIGS. 5 and 6 are top plan and bottom plan views respectively of the composite snowshoe of FIG. 4.
Figure 6:
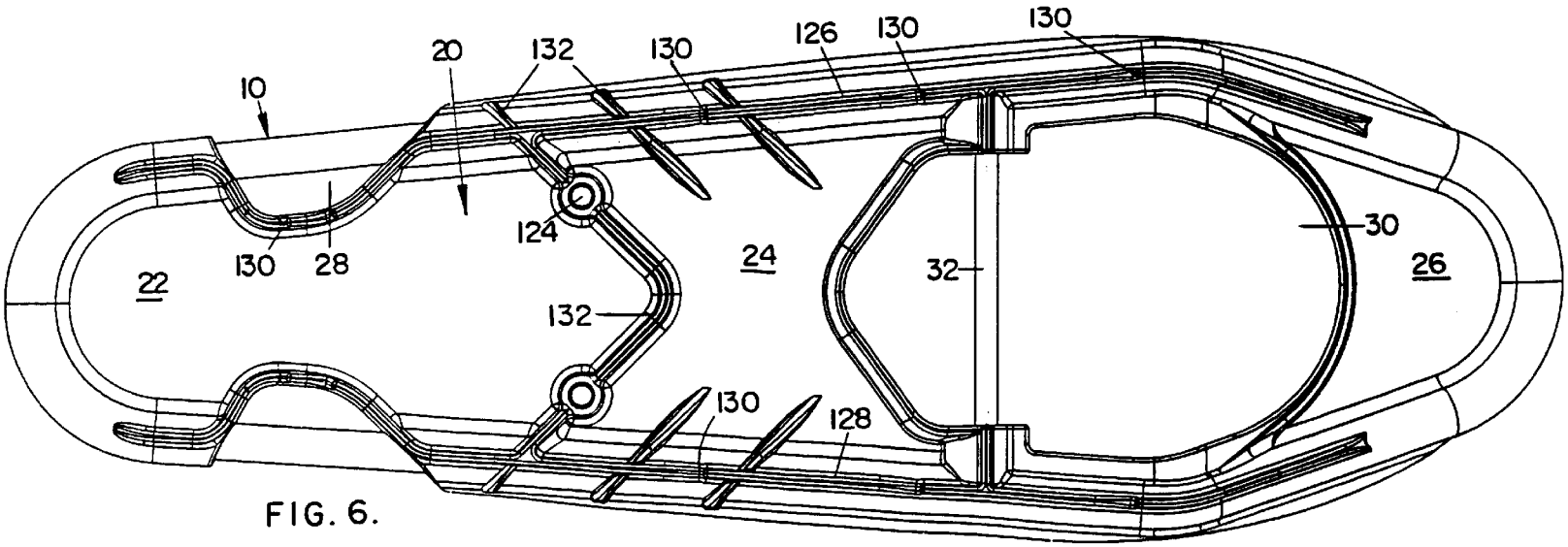
Figure 7:
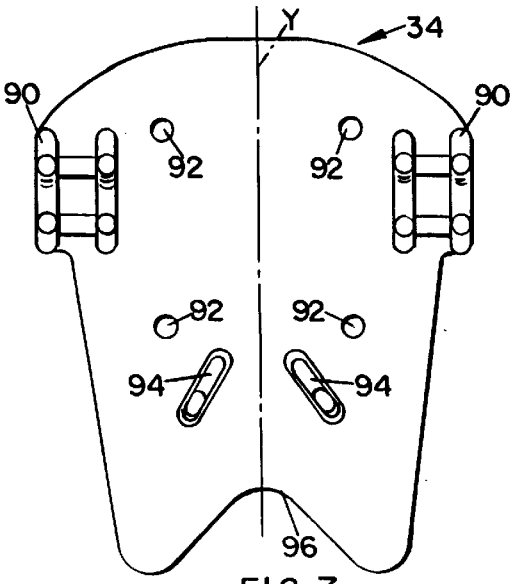
FIG. 7 is a bottom plan view of the binding plate of the composite snowshoe of FIGS. 1 and 2.
Figure 8:
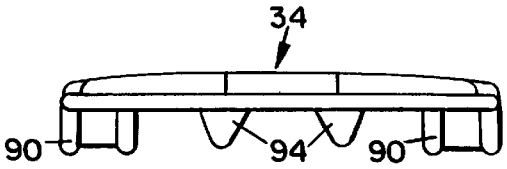
FIG. 8 is an end elevational view of the binding plate of FIGS. 1 and 2 as seen from the right.
Figure 9:
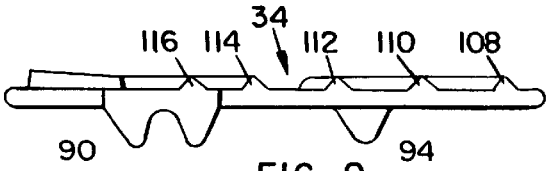
FIG. 9 is a side elevational view of the binding plate.
Figure 10:
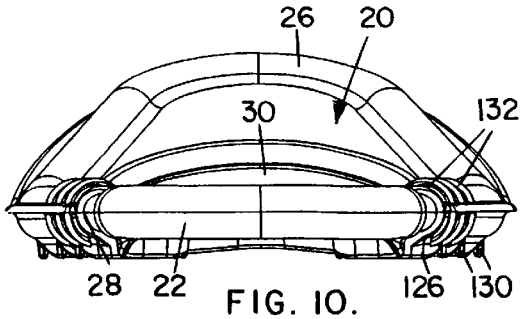
FIG. 10 is an end elevational view of the composite snowshoe of FIG. 4 as seen from the left.
Figure 12:
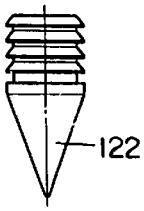
FIG. 12 is a front elevational view of one of the ground engaging spikes or cleats of the snowshoe of the invention.
Figure 11:
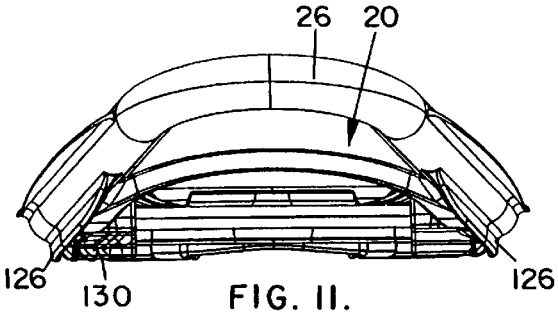
FIG. 11 is an end elevational view of the composite snowshoe of FIG. 4 as seen from the right.

As best seen in FIGS. 1, 2 and 4, binding plate 34 also provides a base or support for a boot harness assembly 36 which includes a semi-rigid plastic toe stop 38 fabricated from QUALEX, a unique, plastic harness 40 fabricated from HYPOLON, a pair of plastic harness stiffeners 42 fabricated from QUALEX, a metal crampon 44 fabricated from aluminum, and a plastic crampon cover or "popper" 46 fabricated from QUALEX, all connected to the abinding plate and to each other by metal pop rivets 47 which pass therethrough and are secured at their lower ends by metal lock washers 49 which bear against the lower face of popper 46.

Popper 46 prevents snow from adhering to the lower face of crampon 44.

Harness 40 utilizes all four rivets 47 and passes between axle 32 and binding plate 34.

Toe stop 38 is also held with the four rivets, but passes between crampon 44 and axle 32. Both the harness and toe stop also serve a bearing function as the binding plate pivots.

Harness stiffeners 42 brace and shape harness 40 and serve as decorative parts. Each stiffener is secured by one of the aft binding plate rivets.

The toe stop, harness, stiffeners and popper are fabricated from flexible sheet stock, with the toe stop, stiffeners and popper being of stiffer material than the harness, as aforesaid.

Figure 13:
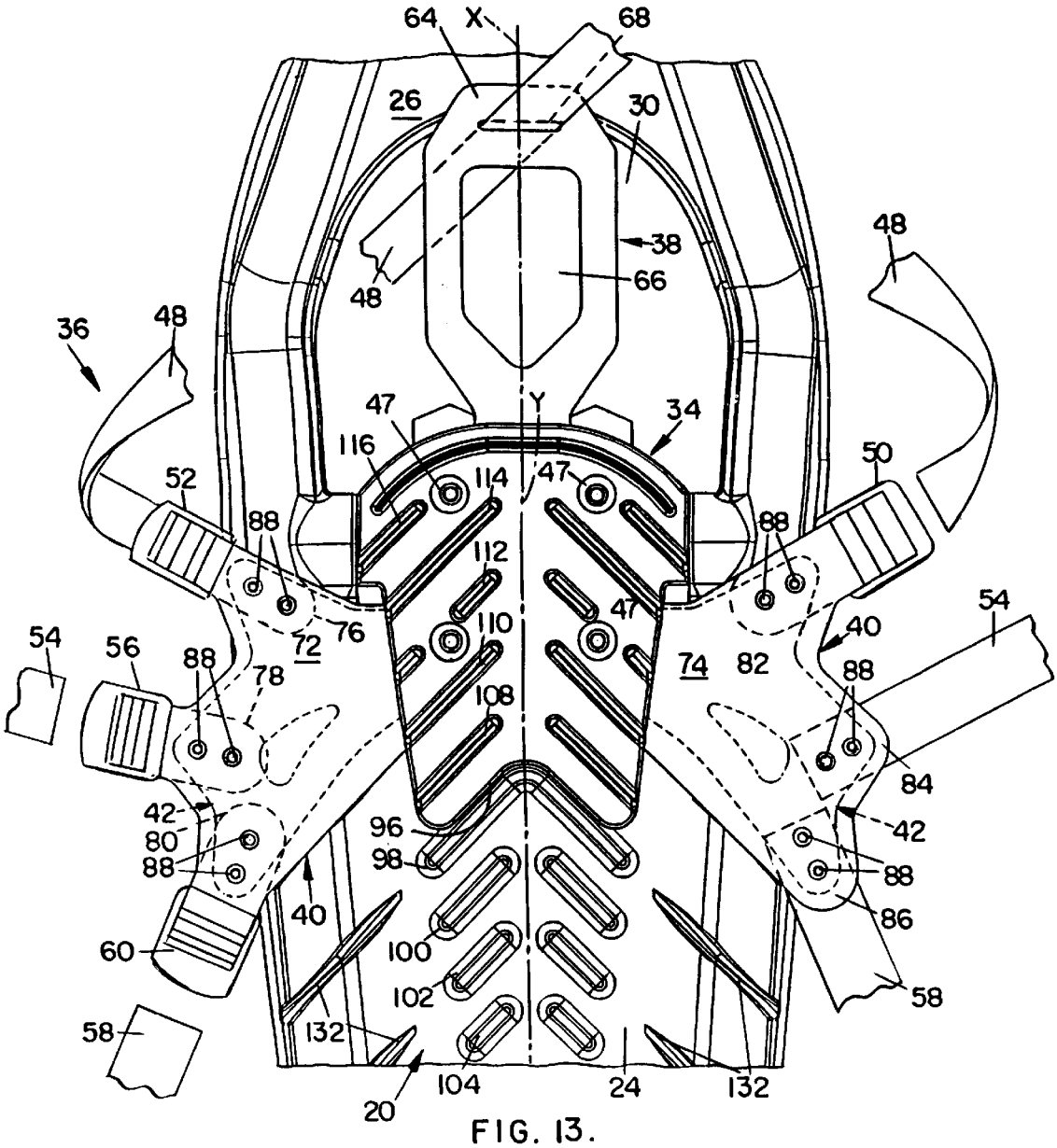
FIG. 13 is a fragmentary, top plan view of the composite snowshoe of the invention with boot binding straps and attachment buckles in place.

As seen in FIG. 1, toe stop 38 comprises a rectangular body 62 having an integral rectangular extension 64, both of which are provided with cut-outs 66 for weight reduction purposes, with extension 64 being provided with a transverse slot 68 at its forward end for the passage of a flexible toe strap 48 therethrough in manner as shown in FIG. 13.

Toe stop 38 extends along the central longitudinal axis X of frame 10.

Harness 40 comprises a rectangular body 70 of a size and configuration substantially coextensive with that of toe stop body 62 having wings 72 and 74 integral therewith which extend transversely outwardly from each side thereof and from each side of binding plate 34.

Wing 72 has spaced forward, middle and rear fingers 76, 78, and 80 respectively formed integrally therewith which extend transversely outwardly from an outer side edge thereof.

Wing 74 has a forward finger 82, a middle projection 84, and a rear projection 86 formed integrally therewith which extend outwardly from an outer edge thereof.

The fingers and projections of wings 72 and 74 and the stiffeners 42 serve as anchors for the harness straps and buckles as will be explained herefollowing.

As best seen in FIG. 13, the fingers are bent back upon themselves and, together with stiffeners 42 and rivets 88, secure buckles and the ends of harness straps to harness assembly 36.

Referring first to wing 74, forward finger 82 thereof is bent back upon itself and passes through a buckle 50 which is anchored in place by rivets 88 which pass through the finger and stiffener 42.

One end of a flexible instep strap 54 is anchored to middle projection 84 of wing 74 by rivets 88 which pass through middle projection 84 and stiffener 42.

One end of a flexible heel strap 58 is anchored to rear projection 86 of wing 74 by rivets 88 which pass through rear projection 88 and stiffener 42.

Referring now to wing 72, forward finger. 76 is bent back upon itself and passes through a buckle 52 which is anchored in place by rivets 88 which pass through the forward finger, one end of the toe strap and stiffener 42.

Middle finger 78 of wing 72 is bent back upon itself and passes through a buckle 56 which is anchored in place by rivets 88 which pass through the middle finger and stiffener 42.

Rear finger 80 of wing 72 is bent back upon itself and passes through a buckle 60 and is anchored in place by rivets 88 which pass through the rear finger and stiffener 42.

In use, the boot of a user, not shown, is placed on binding plate 34 and main body portion 24 of deck 20.

Toe strap 48 is passed over the toe of the boot, through slot 68 of toe stop 38, through buckle 50 on wing 74 of harness 40 and its free end is secured in buckle 52 on wing 72 of harness 40 and the strap is tightened to draw the toe stop, the top strap and the forward end of the harness tight against the forward end and sides of the boot.

Instep strap 54 is then passed over the instep of the boot and its free end is secured in buckle 56 on wing 72 of harness 40 and the instep strap is tightened to draw the instep strap and the midportion of the harness tight against the instep and sides of the boot.

Heel strap 58 is then passed around the heel of the boot and its free end is secured in buckle 60 on wing 72 of harness 40 and the heel strap is tightened to draw the heel strap and the rear end of the harness tight against the sides of the heel portion of the boot.

Binding plate 34 is provided on its lower face with a pair of spaced, aligned, depending bosses 90 disposed at each side edge thereof adjacent its forward end for pivotal engagement with axle 32 and is provided with four spaced through holes 92 for the passage of pop rivets 47 therethrough.

Binding plate 34 is also provided on its lower face at its longitudinal central axis Y adjacent its rearward end with a pair of depending ribs 94 which are angularized relative to central axis Y so as to present a V configuration with an apex pointed toward the forward end of the binding plate to provide added traction and to preclude sideward slippage of the binding plate rearward end upon engagement with the rear walls of deck aperture 30.

The rearward end of binding plate 34 is provided at its longitudinal central axis Y with a V-shaped notch 96 with its apex pointed toward the forward end of the binding plate.

When binding plate 34 is in contact with the upper face of deck main body portion 24, notch 96 is adapted to interlock with a pair of upstanding ribs 98 disposed in a V configuration on the upper face of main body portion 24 of deck 20 at central longitudinal axis X immediately rearwardly of the rear edge of deck aperture 30 thereby providing additional means to preclude lateral slippage of the rear end of binding plate 34.

A series of spaced, upstanding pairs of ribs 100, 102, 104 and 106 is provided centrally of the upper surface of deck main body portion 24 immediately rearwardly of ribs 98, with each pair of ribs also being disposed in a V confirmation in spaced parallelism to each other and to ribs 98.

A series of spaced, upstanding pairs of ribs 108, 110, 112, 114 and 116 is provided on the upper surface of binding plate 34 forwardly of notch 96, with each pair of ribs being disposed along the side edges of the binding plate in a V configuration in spaced parallelism to each other and to ribs 98 of deck 20.

Ribs 108-116 on binding plate 34 and ribs 100-106 on deck 20 provide added traction for the boot of a user.

Crampon 44 is disposed immediately below and embraces the lower surface of body 70 of harness 40 and has a groove 118 located centrally thereof and extending transversely thereacross in which the lower surface of axle 32 is seated.

Crampon cover or "popper" 46 is disposed immediately below and embraces the lower surface of crampon 44 and has a groove 120 complemental to crampon groove 118 located centrally thereof and extending transversely thereacross in which the lower surface of groove 118 is seated.

As aforesaid, pop rivets 47 extend through provided openings in crampon 44 and popper 46 and, together with lock washers 49, affix both components to each other and to harness 40 and to binding plate 34 while permitting pivotal movement of those components relative to axle 32.

Crampon 44 includes an angularly depending serrated forward edge 122 for providing traction when the forward edge of the binding plate is pivoted downwardly.

A pair of spikes or cleats 122 is fixed to and depends from a pair of transversely spaced openings 124 disposed centrally of the lower face of main body portion 24 of the deck rearwardly of deck aperture 30.

Spikes 122 provide additional traction for the snowshoe.

Longitudinally-extending depending ribs 126 and 128 are provided on the underside of deck 20 adjacent each side edge thereof and extend for substantially the entire length of the snowshoe to provide lateral stability when traversing a slope.

Ribs 126 and 128 are also provided with serrations 130 to impart improved traction when climbing an incline.

Spaced diagonally-disposed ribs 132 disposed on the upper and lower faces of deck main body portion 24 adjacent each side edge strengthen longitudinal ribs 126 and 128 and provide additional traction, especially in packed snow.

We claim:

1. A snowshoe comprising a metal frame, a thermosetting plastic deck encapsulating the frame, an integral toe cord axle insert molded with the deck and frame, a composite binding means for gripping and supporting a boot pivotally interconnected to the toe cord axle, and means integral with the binding means and the deck for providing lateral stability when traversing a slope and improved traction when climbing a slope.

2. A snowshoe according to claim 1, wherein the composite binding means comprises a flexible binding and a rigid crampon fixed to a rigid binding plate, the binding plate being pivotally connected to the toe cord axle and movable between a first position wherein one end partially overlies and is engageably interlocked with the deck and wherein an opposite end overlies an aperture in the deck and a second position wherein said one end is free from engagement with the deck and said opposite end extends into the aperture in the deck.

3. A snowshoe according to claim 2, including upstanding ribs on the deck and a notch in said one end of the binding plate in which said ribs are receivable when the binding plate is in said first position.

4. A snowshoe according to claim 2, wherein the flexible binding comprises a soft, high friction member for gripping a boot and a stiffener for imparting rigidity to the soft high friction member.

5. A snowshoe according to claim 2, wherein the flexible binding includes a toe strap, and instep strap and a heel strap.

6. A snowshoe according to claim 1, wherein the means integral with the binding means and the deck for providing lateral stability when traversing a slope and improved traction when climbing a slope comprise a crampon fixed to the binding means, spikes fixed to and depending from the lower surface of the deck, and serrated longitudinal ribs and diagonal ribs integral with and depending from the lower surface of the deck.

* * * * *